United States Patent [19]

Canney

[11] 4,416,478

[45] Nov. 22, 1983

[54] TAMPER DETERENT SEAL PROVIDING INDICATION OF TAMPERING FOR WATTHOUR METERS

[75] Inventor: Robert S. Canney, Berwick, Me.

[73] Assignee: General Electric Co., Somersworth, N.H.

[21] Appl. No.: 205,466

[22] Filed: Nov. 10, 1980

[51] Int. Cl.[3] ..... B65D 33/34
[52] U.S. Cl. ..... 292/307 R
[58] Field of Search ..... 292/307, 327, 316, 323

[56] References Cited

U.S. PATENT DOCUMENTS

| | | | |
|---|---|---|---|
| 1,487,885 | 3/1924 | Raphael | 292/327 |
| 2,548,104 | 4/1951 | Frison | 292/307 R X |
| 2,772,109 | 11/1956 | Busch et al. | 292/307 R |

FOREIGN PATENT DOCUMENTS

| | | | |
|---|---|---|---|
| 2753285 | 5/1979 | Fed. Rep. of Germany | 292/307 R |
| 970463 | 6/1950 | France | 292/323 |

*Primary Examiner*—Richard E. Moore
*Attorney, Agent, or Firm*—Robert E. Brunson

[57] ABSTRACT

A combination meter, meter box and frangible seal for deterring unauthorized access to the meter and visually indicating, when the seal is broken, at least an unauthorized attempt has been made to access the meter.

9 Claims, 8 Drawing Figures

TAMPER DETERENT SEAL PROVIDING INDICATION OF TAMPERING FOR WATTHOUR METERS

BACKGROUND OF THE INVENTION

1. Field of the Invention

The present invention relates generally to seals for meter sockets or boxes and more particularly to a new and improved means for sealing a meter box to deter the unauthorized opening thereof, including means for providing a visual indication of actual or attempted unauthorized entry to the meter box.

2. Description of the Prior Art

One of major problems power utility companies are continuously combating is power theft due to the unauthorized acts of meter tampering or the diversion of current by the consumer. To carry out these unauthorized acts, a consumer must gain access to the meter. This is usually done by breaking a seal, or other locking device, to open the front cover on the meter box. Once the cover is removed, it is then possible to tamper with the meter, or to place a jumper across certain terminals on the meter or the meter socket, to thus divert current around the meter.

To prevent the above type of unauthorized access, various means have been designed to make meter boxes as nearly tamper-proof as possible. Many of these designs utilize some type of breakable seal attached to the meter box which, when broken, provides a visual indication of either attempted or actual unauthorized access.

There are several known types of prior art meter boxes or enclosures which employ breakable seals for the purpose described above. Such known types are disclosed in U.S. Pat. Nos. 1,995,878; 2,081,627; 2,142,048; and 2,113,744.

Each of the above patents discloses a specifically designed meter box wherein a seal must be broken to gain access to a screw for removing the meter box cover or to allow a special key to be inserted to remove the cover.

Another prior art U.S. Pat. No. 1,037,010, discloses a specially designed enclosure or box having a breakable seal, which serves as a lock and unauthorized access indicator. In this patent, a breakable seal is inserted through the front cover of the box and engages with a holding means forming a part of the box. In order to open the front cover, the seal must be broken, thus giving an indication of unauthorized tampering or access.

While the above types of sealing arrangement have met with some commercial success, that success has been limited because of the expense to the utility companies in having to purchase and install a new specially designed meter box incorporating the seal and locking arrangement. Thus, it can be seen that a need exists for the provision of a breakable seal and locking arrangement for meter boxes which can be economically purchased or which lends itself to field implementation in such a fashion that a new meter box need not be purchased and installed.

SUMMARY OF THE INVENTION

The present invention overcomes the aforementioned necessity and expense of specially designed meter boxes by the provision of a combination frangible seal of novel construction for insertion through an aperture in a modified or replacement cover of a meter box and a spring locking member on the meter in the box for lockingly engaging the seal to prevent opening the cover without fragmentizing the seal.

The seal of the present invention is designed to fragmentize into many irregularly shaped pieces with very little stress. By making the seal to so fragmentize, it makes it extremely difficult for anyone to reconstruct the seal and replace it. Once the seal is destroyed, or its shape distorted by breakage, a positive indication of unauthorized meter box tampering is visible upon observation. The seal is further designed to recess into the meter box cover to prevent anyone from slipping an object between the seal and the cover to pry out the seal, or to otherwise attempt to remove it.

It is therefore an object of the present invention to provide a meter box and seal arrangement of economical design having enhanced characteristics.

It is another object of the present invention to provide a combination meter box, meter and seal arrangement adapted to secure the meter and the meter box cover together to prevent access to the meter box without fragmentizing the seal.

Yet another object of the invention is to provide a frangible seal of novel construction for use with meter boxes which will readily fragmentize into irregularly shaped pieces when subjected to very little stress.

It is a further object of the present invention to provide a frangible seal, in combination with a meter and meter box, adapted to lockingly engage the meter and to recess into a cover of the meter box to prevent tampering with the seal without fragmentizing it.

BRIEF DESCRIPTION OF THE DRAWING

Other objects, features and advantages of the present invention will become more fully apparent from the following detailed description of the preferred embodiment, the appended claims and the accompanying drawing in which:

DESCRIPTION OF THE PREFERRED EMBODIMENT

Figure 1:
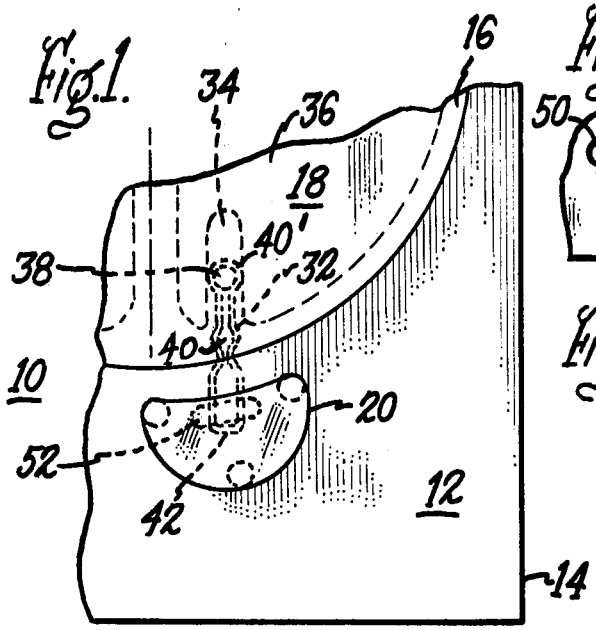
FIG. 1 is a cutaway front view assembly drawing of the invention showing a seal installed on the cover of a meter box lockingly engaging a meter installed in the meter box.

Reference is now made to FIG. 1, which illustrates a conventional utility meter installation shown generally as 10. FIG. 1 is a partial front view of such an installation comprised of a meter socket or box 12, with its attendant removable cover 14. One such meter box suitably adaptable for use with the present invention is a model 741X, Type SI-60, manufactured by General Electric Company.

The cover 14 on this type of meter box is hinge mounted at the top of the box and contains a cutout or opening 16 having a shoulder (not shown) for holding a kilowatt hour meter 18 inside the box, once the meter has been installed. The opening 16 is sized to pass over the meter glass housing to allow the cover 14 to be moved outwardly at the bottom of the meter box, so that the cover can be hinged upward and removed from the box.

Figure 4:
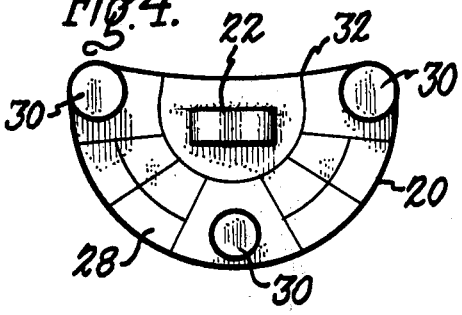
FIGS. 4, 5 and 6 are end, side and bottom views respectively, illustrating the structural details of the seal of the present invention.
Figure 5:
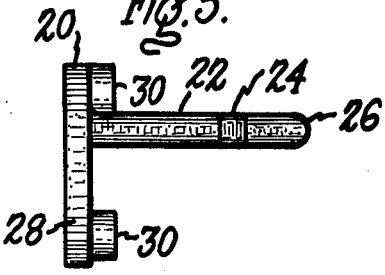
Figure 6:
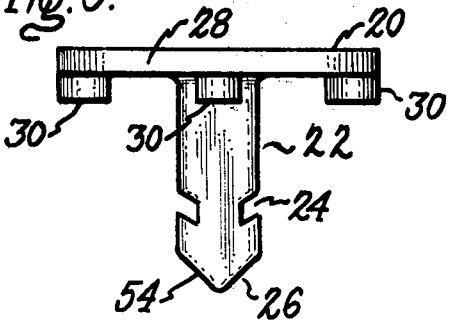

Still referring to FIG. 1, there is shown a frangible seal 20 installed through the cover 14 when the cover is in place on the meter box 12. As best shown in FIGS. 4–6, the seal 20 includes a stem 22 having a notch 24 on one end 26 of the stem. The seal also includes a flange portion or head 28 on the other end of the stem 22.

As shown in the drawing, a plurality of pins, or recess members 30, are formed on the stem side of the head 28. The purpose of the pins 30 will subsequently be described.

While the seal 20 may be made from various types of frangible materials, in the preferred embodiment, it is a one piece molded glass structure. Glass seals of this type can be manufactured using well known glass molding and tempering techniques. The seal 20, and particularly the head 28, is tempered to readily fragmentize when placed under very little stress or if struck with a solid object.

To aid in the breakage characteristics of the seal, a pattern of grooves or indentations 32 (FIGS. 4 and 8) is molded or formed in the head 28. While the grooves 32 are shown formed on the stem side of the head, it is to be understood that a pattern of grooves could also be formed on either or both sides of the head.

The grooves 32, while making the seal more frangible, serve an additional important function. That function is to cause the head 28 to easily fragmentize into many irregularly shaped pieces. These irregularly shaped pieces, make it extremely difficult for the seal to be re-assembled, such as by piecing them back together. This has the advantage that, once the seal is broken, it provides a permanent visual indication of unauthorized tampering.

Reference is made back to FIG. 1, where there is illustrated a retaining member shown, as a spring clip 32, mounted on the meter 18. While the clip 32 may be attached to the meter in a number of different ways, in the preferred embodiment, it is slideably mounted in a slot 34 formed in the base 36 of the meter. A clip retaining means, such as a rivet or screw 38, is passed through the clip and secured to the base to hold the clip in place.

While the slot 34 is not a requirement for mounting the clip 32, it does provide a convenient means for storing the clip while it is in use, or storing it out of the way when the meter is removed from he meter box 12. As can best be seen by FIGS. 1 and 7, the clip has two eyelets 40 and 40'. When the clip is in the operating or use position as shown in FIG. 1, eyelet 40' is in engagement with the clip retaining means 38, thus securing the end 42 of the clip beyond the outer edge of the meter base 36. When the clip is to be stored out of the way, it may merely be slid inward of the base so that the eyelet 40 engages the retaining means 38. When the clip is stored, its end 42 no longer protrudes beyond the edge of the meter base.

Figure 7:
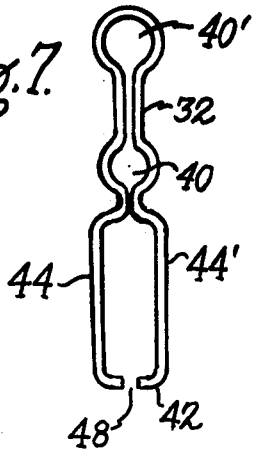
FIG. 7 is a detailed drawing of a spring clip for attachment to the base of a meter in accordance with the invention.

Referring to FIG. 7, it can be seen that the clip 32 is a one piece resilient member having juxtapositionally disposed leg members 44 and 44'. These members are spaced apart at their tips, as shown at 48, to allow the leg members 44 and 44' to spring apart.

Figure 3:
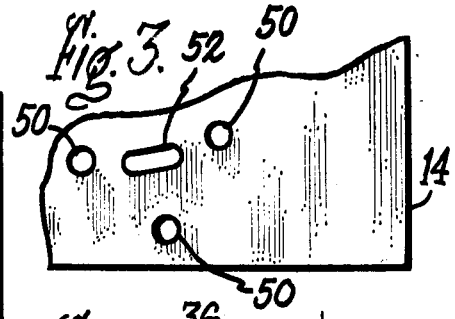
FIG. 3 is a front view of a portion of a meter box cover illustrating the placement thereon of several apertures for receiving the seal.
Figure 2:
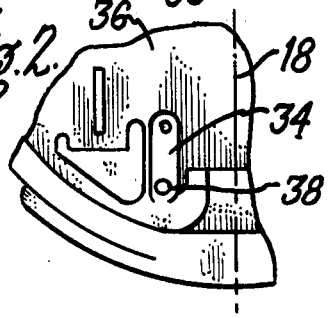
FIG. 2 is a cutaway view of the base of a kilowatt hour meter in accordance with the present invention illustrating the placement thereon of a slot and rivet hole for retaining a spring clip.
Figure 8:
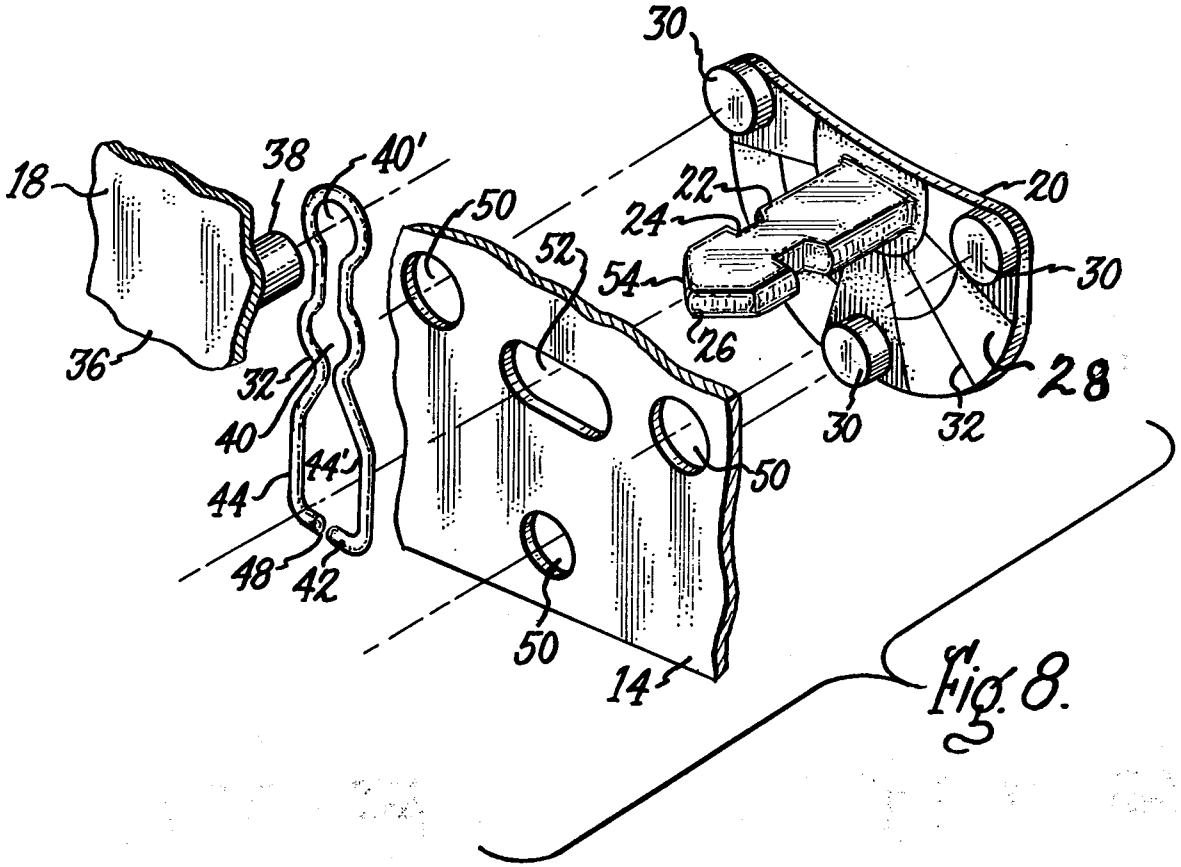
FIG. 8 is an exploded perspective view illustrating the interrelationships of the several components of the present invention.

Referring now to FIGS. 3 and 8, it can be seen that the meter box cover 14 contains a plurality of recess apertures 50 surrounding an opening, such as slot 52, formed in the cover. The purpose and function of the apertures 50 and slot 52 will become readily apparent in the following operational description of the invention.

FIGS. 1 and 8 best illustrate the operational characteristics of the invention. In FIG. 1, the seal 20 is shown installed on the meter cover 14. It should be noted that the spring clip 32 is positioned on the meter 18 so as to be in alignment with the slot 52. Thus, when the stem 22 of the seal is inserted through the slot 52, the end 26 of the stem readily mates with the leg members 44 and 44'. As the seal is pressed into the meter cover, sloping edges 54 on the end of the stem urge the leg members apart. When the seal is fully installed, the leg members 44 and 44' snap into the notch 24 on the stem, thus preventing withdrawal of the seal.

The length of the stem and the position of the notch 24, with respect to the location of the clip 32, is designed so that the head 28 fits snug against the meter cover when the seal is in position. As shown in FIG. 8, the recess members 30 on the head 28 are positioned to align with the mating apertures 50. When the seal head 28 is in place, the members 30 are recessed into the apertures 50.

The recess apertures 30 provide an additional security feature of the seal. It is contemplated that an unauthorized person will attempt to slip a thin object or cutting instrument, such as a wire saw, between the meter cover and the seal head. If such an instrument could be so employed, without breaking the head, a person might be able to cut through the stem 22, thus severing the head, in tact, from the stem. The recess members 30 and apertures 50 combine to prevent a person from using such a cutting instrument. To employ such an instrument, a person would have to pry one of the recess pins 30 out of its aperture in order to slip the cutting instrument between the head 28 and the meter cover 14. Any such prying will, of course, fragmentize the seal.

In the embodiment disclosed, the stem 22 is shown to be of rectangular configuration. The stem, however, could also be of a round construction.

In view of the preceding, it can now be seen how the combination of elements comprising the invention can be employed to provide a low cost meter box seal and indicator of unauthorized tampering.

Manufacturers continually strive to design products of standard design, some of which provide the capability of optional implementation by the customer. The cost advantages, to the manufacturer and the customer, of such standard design are obvious. The present invention lends itself to standard design.

It is contemplated that meter covers, such as cover 14, will be manufactured with the apertures 50 and slot 52 stamped in the cover as knock-out plugs. Further, it is contemplated that all meters, such as meter 18, will be manufactured to contain a clip 32 as a standard feature. Thus, having a standard cover and a meter with its attendant clip, the customer need only knock-out the plugs and insert a seal to employ the invention.

The invention is also suitable for field retrofit by the customer. If such a retrofit is desired, the customer need merely order a kit from the manufacturer. It is contemplated that such a kit will include a seal, a template showing where to drill the apertures 50 and 52 in the cover, a clip 32 and retainer 38 along with instructions of where and how to mount the clip on the meter.

The cost advantages of the preceding type of retrofit become attractive when it is recognized that the customer does not have to purchase a new meter cover and meter to make use of the invention.

The head 28 of the seal 20 should also be of a bright color, to contrast with the color of the meter box cover 14. This contrast in colors makes the seal 20 easily visible from a distance of several feet. Utility company personnel, knowing the normal shape of the seal, can thus easily detect if the seal has been broken.

While the present invention has been disclosed in connection with a preferred embodiment thereof, it should be understood that there may be other embodiments which fall within the spirit and scope of the invention as defined by the appended claims.

What is claimed is:

1. The combination comprising:

(a) a seal constructed of a frangible material forming a replaceable element, said seal including a stem having a notch formed in one end thereof and having, at its other end, a head capable of being readily fragmented when placed under stress;

(b) a kilowatt hour meter including a clip configured to receive the stem of said seal and engage the notch in the one end of the stem of said seal; and (c) a meter box for mounting said kilowatt hour meter, said meter box having a removable cover configured to press against a portion of said kilowatt hour meter when said cover is installed on said meter box to retain said kilowatt hour meter in said meter box, said cover having an opening formed in a portion thereof which is in alignment with said clip on said kilowatt hour meter, whereby, when the stem of said seal is inserted through the opening the notch on the stem of said seal lockingly engages said clip, to secure said cover to said meter box and provide a seal which, when placed under stress, fragmentizes to provide a visual indication of at least attempted unauthorized tampering to gain access to the inside of said meter box.

2. The combination in accordance with claim 1, wherein the head of said seal includes a plurality of grooves formed in at least one side thereof to cause the head to readily fragmentize into a plurality of irregularly shaped pieces when said seal is placed under stress.

3. The combination in accordance with claim 1, wherein said cover of said meter box further includes a plurality of apertures surrounding the opening in said cover and the head of said seal includes a matching plurality of recess pins thereon which recess into the apertures in said cover when said seal is installed on the meter box.

4. The combination in accordance with claim 1, wherein said clip is mounted on a base of said kilowatt hour meter, and formed with juxtapositionally disposed spring leg members having an opening therebetween for receiving the stem and lockingly engaging with the notch in said stem.

5. The combination in accordance with claim 1, wherein said seal is constructed of glass, at least the head of which is tempered to readily fragmentize.

6. In a utility installation of the type including a meter mounted in a meter box apparatus for deterring unauthorized access to the meter, and visually indicating at least an attempt has been made to make such unauthorized access, said apparatus comprising:

(a) a spring clip mounted at one end thereof on the meter, with the other end of said spring clip extending beyond the outer edge of the meter;

(b) a cover removably mounted on the meter box for gaining access to the meter, said cover having an opening formed in a portion thereof substantially in alignment with that end of said spring clip extending beyond the outer edge of the meter; and (c) a seal constructed of a frangible material forming a replaceable element, said seal including a stem having a notch formed in one end thereof and having at its other end a head capable of being readily fragmented when placed under stress, said seal serving to lock said meter box, whereby, upon insertion of said stem of said seal through the opening in said cover of the meter box, the notch on said stem lockingly engages that end of said spring clip extending beyond the outer edge of the meter with said head of said seal snug against said cover and thereby locking the meter box with said seal such that, if said seal is placed under stress by an attempt to remove said seal, said seal will fragmentize and provide a visual indication of at least an attempt to gain unauthorized access to the meter.

7. The apparatus in accordance with claim 6, wherein said seal is constructed of glass, at least the head of which is tempered to readily fragmentize.

8. The apparatus in accordance with claim 7, wherein the head of said seal includes a plurality of grooves formed in at least one side thereof to cause the head to readily fragmentize into a plurality of irregularly shaped pieces when said seal is placed under stress.

9. The apparatus in accordance with claim 8, wherein said cover of the meter box further includes a plurality of apertures surrounding the opening in said cover and the head of said seal includes a matching plurality of recess pins thereon which recess into the apertures in said cover when said seal is installed on the meter box to prevent a thin object from being inserted between the head of said seal and said cover.

* * * * *